US009460652B2

(12) United States Patent
Imai et al.

(10) Patent No.: US 9,460,652 B2
(45) Date of Patent: Oct. 4, 2016

(54) DISPLAY DEVICE AND METHOD FOR CONTROLLING DISPLAY DEVICE

(71) Applicant: Japan Display Inc., Minato-ku (JP)

(72) Inventors: Takayuki Imai, Tokyo (JP); Norio Nakamura, Tokyo (JP)

(73) Assignee: Japan Display Inc., Minato-ku (JP)

( * ) Notice: Subject to any disclaimer, the term of this patent is extended or adjusted under 35 U.S.C. 154(b) by 32 days.

(21) Appl. No.: 14/546,372

(22) Filed: Nov. 18, 2014

(65) Prior Publication Data

US 2015/0138257 A1 May 21, 2015

(30) Foreign Application Priority Data

Nov. 18, 2013 (JP) ..... 2013-237784

(51) Int. Cl.
*G09G 3/3208* (2016.01)
*G09G 3/32* (2016.01)

(52) U.S. Cl.
CPC .... *G09G 3/3208* (2013.01); *G09G 2320/0242* (2013.01); *G09G 2320/0276* (2013.01); *G09G 2320/046* (2013.01); *G09G 2320/0666* (2013.01); *G09G 2320/0673* (2013.01); *G09G 2330/021* (2013.01)

(58) Field of Classification Search
CPC ..... G09G 3/3208; G09G 2320/0276; G09G 2320/0673; G09G 2320/043; G09G 2320/0242; G09G 2320/0666; G09G 2330/021
See application file for complete search history.

(56) References Cited

U.S. PATENT DOCUMENTS

2006/0146005 A1* 7/2006 Baba ..... G09G 3/3233 345/102
2007/0126672 A1* 6/2007 Tada ..... G09G 3/3233 345/77
2010/0315444 A1 12/2010 Mori et al.

FOREIGN PATENT DOCUMENTS

JP 2011-002520 1/2011

* cited by examiner

*Primary Examiner* — Liliana Cerullo
(74) *Attorney, Agent, or Firm* — Oblon, McClelland, Maier & Neustadt, L.L.P.

(57) ABSTRACT

According to one embodiment, a display device displays an $n-1^{th}$ frame (n is an integer which is greater than or equal 2) and an $n^{th}$ frame in this order. The display device includes a display panel, calculator, adjuster, and controller. The calculator calculates power consumption of the $n-1^{th}$ frame. The adjuster determines whether or not the $n^{th}$ frame is brighter than the $n-1^{th}$ frame, and adjusts brightness of the $n^{th}$ frame based on a brightness adjustment magnification of the $n^{th}$ frame calculated based on the power consumption of the $n-1^{th}$ frame and a decreasing function, when the $n^{th}$ frame is not brighter than the $n-1^{th}$ frame. The controller stops light emission with an arbitrary timing when the $n^{th}$ frame is displayed, when the $n^{th}$ frame is brighter than the $n-1^{th}$ frame.

16 Claims, 6 Drawing Sheets

DISPLAY DEVICE AND METHOD FOR CONTROLLING DISPLAY DEVICE

CROSS-REFERENCE TO RELATED APPLICATIONS

This application is based upon and claims the benefit of priority from Japanese Patent Application No. 2013-237784, filed Nov. 18, 2013, the entire contents of which are incorporated herein by reference.

FIELD

Embodiments described herein relate generally to a display device and a method for controlling the display device.

BACKGROUND

A display device is, for example, an organic electroluminescence display device. An information terminal such as a mobile phone or a smartphone, which includes the display device, operates by a battery, for example, a lithium-ion battery. It is therefore desirable that power consumption of the display device be restricted. However, with respect to the display device, in general, as brightness becomes higher, the power consumption thereof is also increased. Therefore, to restrain power consumption, the display device may include a circuit controlling the brightness.

However, if the brightness is simply adjusted to restrain power consumption, for example, a flash phenomenon in which brightness becomes large for a moment may occur to deteriorate a display grade and make displayed content unnatural.

There is a technique of preventing the flash phenomenon by storing a frame in a frame memory before displaying the frame and making a brightness adjustment. However, in this case, since the frame memory is provided to the display device, a manufacturing costs increases.

DETAILED DESCRIPTION

In general, according to one embodiment, a display device displays an $n-1^{th}$ frame (n is an integer which is greater than or equal to 2) and an $n^{th}$ frame included in display data in this order. The display device includes a display panel, a calculator, an adjuster, and a controller. The display panel displays an image based on the display data. The calculator calculates power consumption of the $n-1^{th}$ frame. The adjuster determines whether or not the $n^{th}$ frame is brighter than the $n-1^{th}$ frame, and adjusts brightness of the $n^{th}$ frame based on a brightness adjustment magnification of the $n^{th}$ frame calculated based on the power consumption of the $n-1^{th}$ frame and a decreasing function, when the $n^{th}$ frame is not brighter than the $n-1^{th}$ frame. The controller stops light emission with an arbitrary timing when the $n^{th}$ frame is displayed, when the $n^{th}$ frame is brighter than the $n-1^{th}$ frame.

Embodiments of the present invention will be hereinafter described with reference to the accompanying drawings. It should be noted that in the following description, the same or substantially the same functions or structural elements are given the same numbers, and explanations thereof will be omitted or will be made as necessary.

In each of the embodiments, the case where the display device is an organic electroluminescence display device will be described as an example. However, the display device may be a liquid crystal display device or the like.

First Embodiment

A display device according to the present embodiment restricts power consumption by adjusting a light emission time for each frame included in display data from a processor, and restricts deterioration of a display grade, preventing a flash phenomenon.

Figure 1:
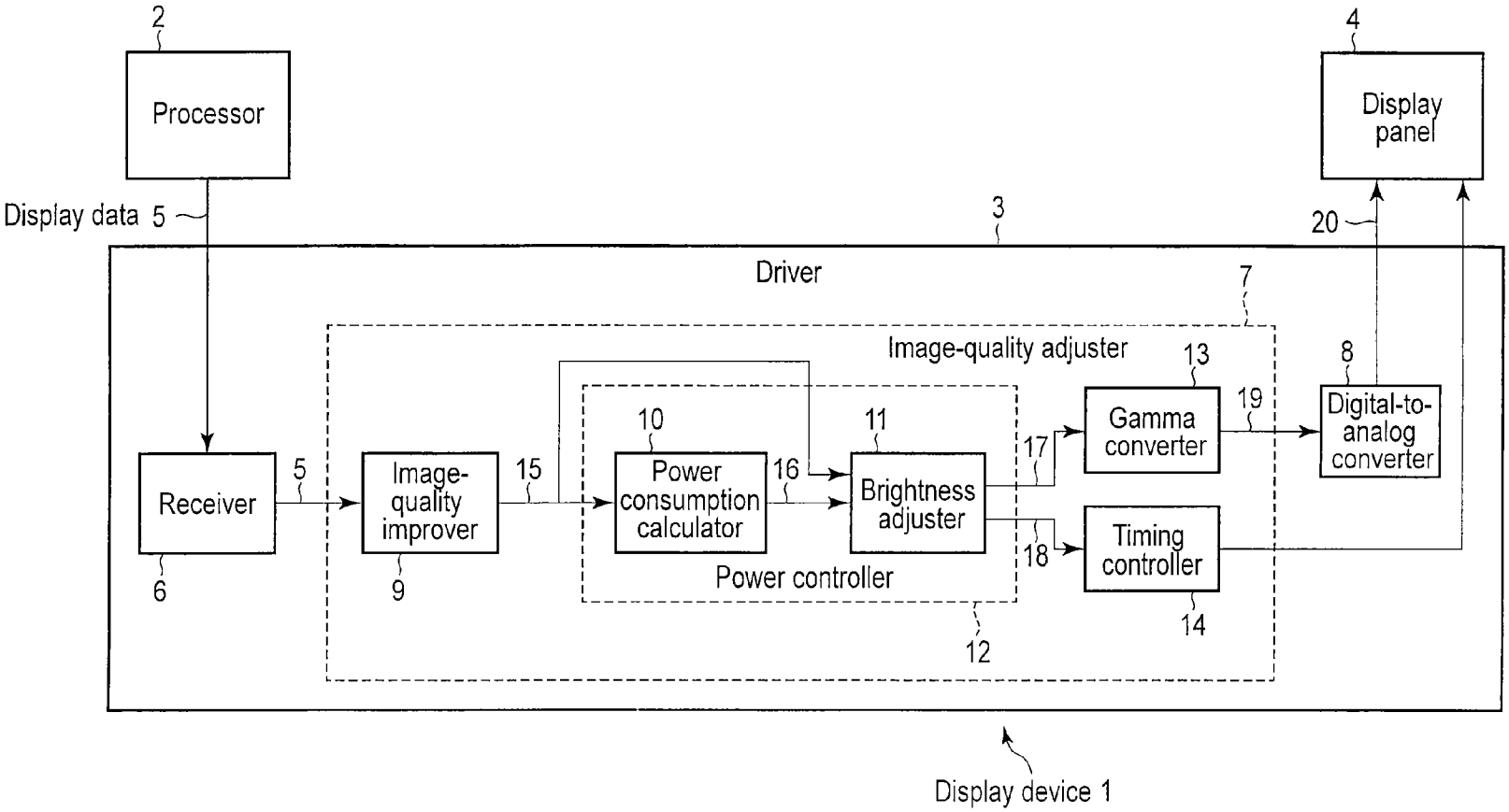
FIG. 1 is a block diagram showing an example of a structure of a display device according to a first embodiment.

FIG. 1 is a block diagram showing an example of a structure of a display device 1 according to the present embodiment.

A display device 1 includes a processor 2, a driver 3, and a display panel 4.

The display device 1 displays an $n-1^{th}$ frame (n is an integer which is greater than or equal to 2) and an $n^{th}$ frame included in display data in this order.

The processor 2 is, for example, an application processor. The processor 2 transmits display data 5 which is a differential signal to the driver 3. A device which outputs the display data 5 may not be the processor 2, but other devices, for example, a memory device.

The driver 3 converts the display data 5 from the processor 2 into a signal line voltage suitable for the display panel 4. The driver 3 includes a receiver 6, an image-quality adjuster 7, and a digital-to-analog converter 8. The driver 3 is, for example, an integrated circuit.

The receiver 6 receives the display data 5 from the processor 2, and transmits the display data 5 to the image-quality adjuster 7.

The image-quality adjuster 7 receives the display data 5 from the receiver 6, adjusts brightness to limit power consumed for display, and controls a light emission time of a frame of the display data 5 as necessary.

The image-quality adjuster 7 includes a power controller 12, a gamma converter 13, and a timing controller 14. The power controller 12 includes an image-quality improver 9, a power consumption calculator 10, and a brightness adjuster 11.

The image-quality improver 9 improves the display data 5 by processing, for example, noise reduction, and transmits improved display data 15 to the power consumption calculator 10.

The power consumption calculator 10 calculates an integrated value of power consumed to display each pixel in a frame included in the display data 15 based on the improved display data 15 and a coefficient by which brightness (corresponding to a pixel value and gradation data) is converted into power consumption, generates power consumption 16 of the frame, and transmits the power consumption 16 to the brightness adjuster 11. For example, the power consumption calculator 10 successively calculates power consumption of each frame of the display data 5 including the $n-1^{th}$ frame and the $n^{th}$ frame.

The brightness adjuster 11 receives the improved display data 15 from the image-quality improver 9, and receives the power consumption 16 from the power consumption calculator 10.

The brightness adjuster 11 determines a brightness adjustment magnification which decreases as power consumption increases based on a decreasing function, calculates output data 17 obtained by multiplying the brightness of the display data 15 and the brightness adjustment magnification, and transmits the output data 17 to the gamma converter 13.

The brightness adjustment magnification is such a small value that power consumed for display is sufficiently restricted, and is, for example, a value less than one.

In the present embodiment, the brightness adjuster 11 determines whether or not the $n^{th}$ frame to be displayed is brighter than the previous $n-1^{th}$ frame and whether or not the power consumption 16 of the $n^{th}$ frame exceeds a predetermined threshold value Th1. Then, the brightness adjuster 11 transmits a black insertion signal 18 for the $n^{th}$ frame to the timing controller 14, when the $n^{th}$ frame is brighter than the $n-1^{th}$ frame and the power consumption 16 of the $n^{th}$ frame exceeds the predetermined threshold value Th1.

As the threshold value Th1, for example, such a value that the $n^{th}$ frame does not cause a flash phenomenon is set.

For example, the brightness adjuster 11 may determine whether or not the $n^{th}$ frame is brighter than the $n-1^{th}$ frame, by comparing the power consumption of the $n^{th}$ frame and the power consumption of the $n-1^{th}$ frame.

For example, the brightness adjuster 11 may determine whether or not the $n^{th}$ frame is brighter than the $n-1^{th}$ frame, by comparing the brightness of the $n^{th}$ frame and the brightness of the $n-1^{th}$ frame.

For example, the brightness adjuster 11 may determine whether or not a difference between the power consumption of the $n^{th}$ frame and the power consumption of the $n-1^{th}$ frame exceeds a threshold value, when the $n^{th}$ frame is brighter than the $n-1^{th}$ frame, and transmit the black insertion signal 18 for the $n^{th}$ frame to the timing controller 14, when the difference in power consumption exceeds the threshold value.

For example, the brightness adjuster 11 may determine whether or not a difference between the brightness of the $n^{th}$ frame and the brightness of the $n-1^{th}$ frame exceeds a threshold value, when the $n^{th}$ frame is brighter than the $n-1^{th}$ frame, and transmit the black insertion signal 18 for the $n^{th}$ frame to the timing controller 14, when the difference in brightness exceeds the threshold value.

The gamma converter 13 executes processing such as gamma conversion of the output data 17, and transmits a digital signal 19 for which gamma conversion has been carried out to the digital-to-analog converter 8.

The digital-to-analog converter 8 converts the digital signal 19 into an analog signal 20, and applies a voltage based on the analog signal 20 to the display panel 4. In other words, the digital-to-analog converter 8 converts the digital signal 19 into a voltage to be written to the display panel 4.

The timing controller 14 stops light emission to the $n^{th}$ frame in the display panel 14, when the timing controller 14 receives the black insertion signal 18 from the brightness adjuster 11. In other words, the timing controller 14 stops light emission based on a timing with which the black insertion signal 18 is received when the $n^{th}$ frame is displayed, when the $n^{th}$ frame is brighter than the $n-1^{th}$ frame.

For example, the timing controller 14 may stop light emission of the $n^{th}$ frame with a timing determined based on the difference in power consumption, when the above-described difference in power consumption exceeds the threshold value.

For example, the timing controller 14 may stop light emission of the $n^{th}$ frame with a timing determined based on the difference in brightness, when the above-described difference in brightness exceeds the threshold value.

A light emission time of the $n^{th}$ frame is thereby adjusted to prevent a flash phenomenon from occurring.

The display panel 4 displays an image based on a signal converted by the digital-to-analog converter 8. Moreover, in the present embodiment, the display panel 4 stops light emission to the $n^{th}$ frame in accordance with adjustment by the timing controller 14, when the $n^{th}$ frame is brighter than the $n-1^{th}$ frame and the power consumption 16 exceeds the threshold value Th1. In this manner, when light emission to the $n^{th}$ frame is stopped, frames after the $n^{th}$ frame are displayed in a state in which black is inserted.

The display panel 4 displays the $n^{th}$ frame to which a brightness adjustment has been made by the brightness adjuster 11, when the $n^{th}$ frame is not brighter than the $n-1^{th}$ frame, or when the power consumption 16 does not exceed the threshold value Th1.

For example, the display panel 4 may display the $n^{th}$ frame to which a brightness adjustment has been made by the brightness adjuster 11, when the $n^{th}$ frame is not brighter than the $n-1^{th}$ frame, or when the above-described difference in power consumption does not exceed the threshold value.

For example, the display panel 4 may display the $n^{th}$ frame to which a brightness adjustment has been made by the brightness adjuster 11, when the $n^{th}$ frame is not brighter than the $n-1^{th}$ frame, or when the above-described difference in brightness does not exceed the threshold value.

In the following, a calculation of the output data 17 in the display device 1 including the above-described structure will be specifically described. In the following description, frames are displayed in the order of the $n-1^{th}$ frame, the $n^{th}$ frame, and an $n+1^{th}$ frame.

In the present embodiment, the display data 15 includes a plurality of frames. The power controller 12 calculates the power consumption (for example, an integrated value obtained by multiplying the brightness of a frame and a coefficient by which the brightness is converted into power consumption together) 16 based on the display data 15, calculates a brightness adjustment magnification based on the calculated power consumption 16, and converts the display data 15 into the output data 17.

Equation (1) is an equation for calculating the power consumption 16 based on the $n^{th}$ frame of the display data 15.

$$\text{Power}_n=\{\Sigma R_{IN(n)}\}\times a_R+\{\Sigma G_{IN(n)}\}\times a_G+\{\Sigma B_{IN(n)}\}\times a_B \quad (1)$$

In Equation (1), $\text{Power}_n$ is the power consumption 16 in the $n^{th}$ frame of the display data 15. The brightness of a red pixel included in the $n^{th}$ frame is $R_{IN(n)}$. The brightness of a green pixel included in the $n^{th}$ frame is $G_{IN(n)}$. The brightness of a blue pixel included in the $n^{th}$ frame is $B_{IN(n)}$. $a_R$ is a coefficient by which the brightness of a red pixel is converted into power consumption. $a_G$ is a coefficient by which the brightness of a green pixel is converted into power consumption. $a_B$ is a coefficient by which the brightness of a blue pixel is converted into power consumption.

A brightness adjustment magnification $K_{n+1}$ for restraining power consumption by reducing the brightness of the $n+1^{th}$ frame is calculated based on Equation (2).

$$K_{n+1}=f(\text{Power}_n) \quad (2)$$

Here, the function f(x) is a decreasing function which satisfies $f(x_1)\geq f(x_2)$, where $x_1<x_2$. If the above-described conversion is applied to the case where the display data 15 is moving image data, the power consumption 16 of the display data 15 is a function of a time t, and the function f(x) is also the function of the time t.

Figure 2:
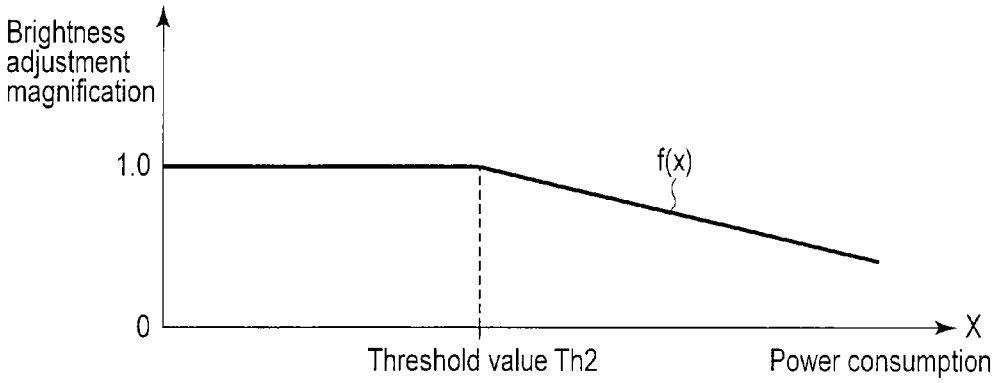
FIG. 2 is a graph showing an example of a decreasing function f(x) for determining a brightness adjustment magnification based on power consumption.

FIG. 2 is a graph showing an example of the decreasing function f(x) for determining a brightness adjustment magnification based on the power consumption 16. Until the power consumption 16 reaches a threshold value Th2, the brightness adjustment magnification is constant and is, for example, one.

When the power consumption 16 exceeds the threshold value Th2, the brightness adjustment magnification decreases as the power consumption 16 increases.

The brightness of a red pixel included in the $n+1^{th}$ frame is $R_{IN(n+1)}$. The brightness of a green pixel included in the $n+1^{th}$ frame is $G_{IN(n+1)}$. The brightness of a blue pixel included in the $n+1^{th}$ frame is $B_{IN(n+1)}$.

In this case, the brightness $R_{OUT(n+1)}$ of a red pixel included in the $n+1^{th}$ frame of the output data 17, the brightness $G_{OUT(n+1)}$ of a green pixel included in the $n+1^{th}$ frame of the output data 17, and the brightness $B_{OUT(n+1)}$ of a blue pixel included in the $n+1^{th}$ frame of the output data 17 are calculated based on Equations (3) to (5), respectively.

$$R_{OUT(n+1)}=K_{n+1}\times R_{IN(n+1)} \quad (3)$$

$$G_{OUT(n+1)}=K_{n+1}\times G_{IN(n+1)} \quad (4)$$

$$B_{OUT(n+1)}=K_{n+1}\times B_{IN(n+1)} \quad (5)$$

As shown in Equations (1) to (5), a brightness adjustment magnification $K_{n+1}$ applied to the brightness adjustment of the $n+1^{th}$ frame is calculated based on the $n^{th}$ frame. Accordingly, a brightness adjustment magnification suitable for each frame is determined with a delay of one frame.

In the following, the light emission time adjustment in the display device 1 will be specifically described.

Figure 3:
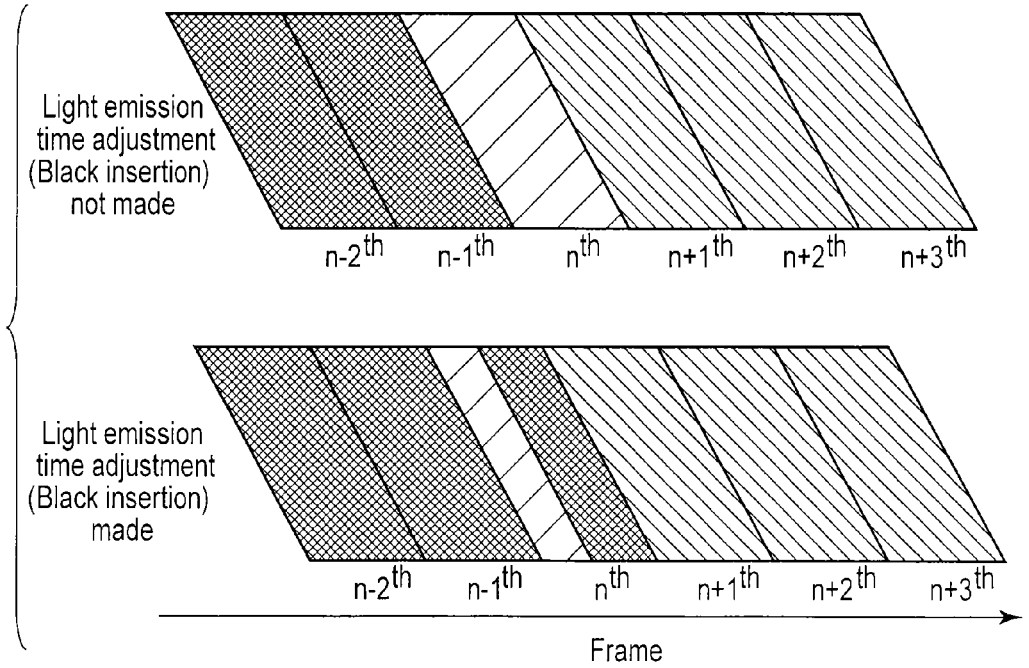
FIG. 3 is an illustration showing a comparative example between a frame display transition without a light emission time adjustment and a frame display transition to which the light emission time adjustment is applied.

FIG. 3 is an illustration showing a comparative example between a frame display transition without a light emission time adjustment (black insertion) and a frame display transition to which the light emission time adjustment is applied.

First, the frame display transition without a light emission time adjustment will be described.

For example, it is assumed that in the display data 15, the $n-1^{th}$ frame and frames before the $n-1^{th}$ frame are dark black frames, and the $n^{th}$ frame and frames after the $n^{th}$ frame are light yellow frames. A brightness adjustment magnification $K_n$ applied to the $n^{th}$ yellow frame is given by $K_n=f(\text{Power}_{n-1})$ based on the power consumption $\text{Power}_{n-1}$ of the $n-1^{th}$ black frame. Therefore, although the $n^{th}$ frame is a yellow frame, a value calculated based on the $n-1^{th}$ black frame is used as the brightness adjustment magnification $K_n$ corresponding to the $n^{th}$ frame.

A brightness adjustment magnification suitable for a yellow frame is given by $K_{n+l}=f(\text{Power}_n)$ on the basis of the consumption power $\text{Power}_n$ of the $n^{th}$ yellow frame, and is used for the $n+1^{th}$ yellow frame and frames after the $n+1^{th}$ yellow frame.

Here, the power consumption $\text{Power}_n$ of the $n^{th}$ yellow frame is greater than the power consumption $\text{Power}_{n-1}$ of the $n-1^{th}$ black frame. A brightness adjustment magnification is determined by a decreasing function which becomes smaller as power consumption becomes greater. Accordingly, the brightness adjustment magnification $K_{n+1}$ applied to the $n+1^{th}$ frame is less than the brightness adjustment magnification $K_n$ applied to the $n^{th}$ frame. Therefore, the $n^{th}$ frame is displayed more brightly than the $n+1^{th}$ frame.

In such a display transition, only the $n^{th}$ frame becomes bright at time of switching of images, and a flash phenomenon occurs.

Next, the frame display transition with a light emission time adjustment will be described.

In the present embodiment, a flash phenomenon is prevented by matching the power consumption or the brightness of the $n^{th}$ frame and the $n-1^{th}$ frame.

In general, to match the $n^{th}$ frame and the $n+1^{th}$ frame, a frame memory in which the display data 15 is stored is used. However, the frame memory needs a capacity for storing data of one frame, and a manufacturing cost increases.

In the present embodiment, for example, when a switch is made from the $n-1^{th}$ dark black frame to the $n^{th}$ light yellow frame, a light emission time of the $n^{th}$ frame is shortened and a black insertion is made into the $n^{th}$ frame to make a brightness adjustment. For the $n+1^{th}$ frame, the brightness adjustment magnification $K_{n+1}$ corresponding to the yellow frame calculated based on the $n^{th}$ frame is used.

In this manner, in the present embodiment, when the $n^{th}$ frame is so brighter than the $n-1^{th}$ frame that a flash phenomenon occurs, light emission is restrained, a black insertion is made, and a difference in power consumption or a difference in brightness between the $n-1^{th}$ frame, and the $n^{th}$ frame and the following $n+1^{th}$ frame is restrained.

Figure 4:
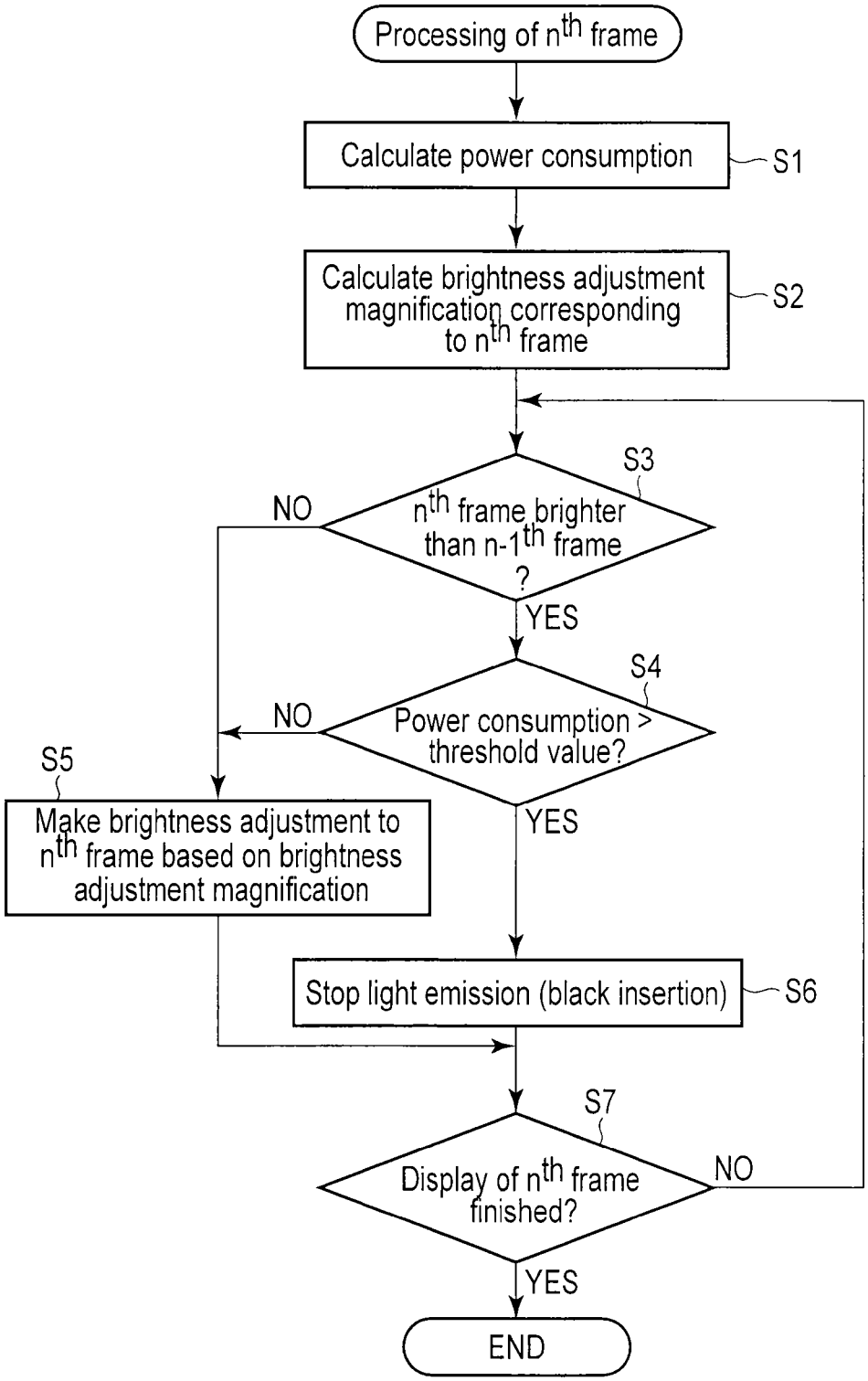
FIG. 4 is a flowchart showing an example of processing of a power controller and a timing controller for an $n^{th}$ frame.

FIG. 4 is a flowchart showing an example of processing of the power controller 12 and the timing controller 14 for the $n^{th}$ frame. The same processing as shown in FIG. 4 is executed for each frame of the display data 15 in order of display.

In step S1, the power consumption calculator 10 calculates the power consumption of the $n-1^{th}$ frame and present power consumption of the $n^{th}$ frame.

In step S2, the brightness adjuster 11 calculates a brightness adjustment magnification $K_n$ applied to the $n^{th}$ frame based on the power consumption of the $n-1^{th}$ frame.

In step S3, the brightness adjuster 11 compares the brightness of the $n-1^{th}$ frame and the brightness of the $n^{th}$ frame, and determines whether or not the $n^{th}$ frame is brighter than the $n-1^{th}$ frame at the present time. The brightness of the $n-1^{th}$ frame and the brightness of the $n^{th}$ frame may be compared, for example, on the basis of the power consumption of the $n-1^{th}$ frame and the present power consumption of the $n^{th}$ frame. In addition, the brightness of the $n-1^{th}$ frame and the brightness of the $n^{th}$ frame may be compared, for example, on the basis of the brightness of the $n-1^{th}$ frame and the brightness of data which has been input until the present time of the $n^{th}$ frame.

When the $n^{th}$ frame is brighter than $n-1^{th}$ frame, the processing proceeds to step S4.

When the $n^{th}$ frame is not brighter than the $n-1^{th}$ frame, the processing proceeds to step S5.

In step S4, the brightness adjuster 11 determines whether or not the present power consumption of the $n^{th}$ frame exceeds a threshold value Th1 which has been set in order not to cause a flash phenomenon. The brightness adjuster 11 may determine whether or not a difference in power consumption or brightness, which is a difference between the power consumption or brightness of the $n-1^{th}$ frame and the power consumption or brightness until the present time of the $n^{th}$ frame, exceeds a threshold value.

When the present power consumption of the $n^{th}$ frame does not exceed the threshold value Th1, the processing proceeds to step S5.

When the present power consumption of the $n^{th}$ frame exceeds the threshold value Th1, the processing proceeds to step S6.

In step S5, the brightness adjuster 11 makes a brightness adjustment to the $n^{th}$ frame based on a brightness adjustment magnification $K_n$ applied to the $n^{th}$ frame, and transmits the output data 17 to the gamma converter 13. Then, the processing proceeds to step S7.

In step S6, the brightness adjuster 11 transmits the black insertion signal 18 to the timing controller 14, and the timing controller 14 stops light emission of the $n^{th}$ frame. Then, the processing proceeds to step S7.

In step S7, when the display of the $n^{th}$ frame is finished, the processing of the $n^{th}$ frame is finished, and when the display of the $n^{th}$ frame is not finished, the processing returns to step S3.

Figure 5:
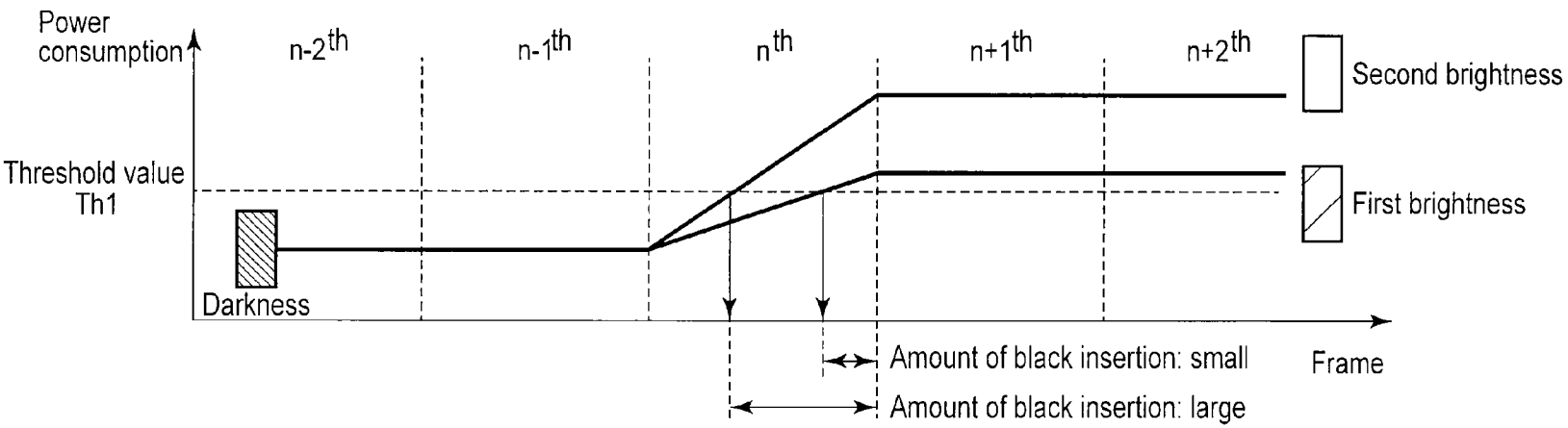
FIG. 5 is a graph showing an example of a relationship between a timing of light emission adjustment and power consumption in the display device according to the first embodiment.

FIG. 5 is a graph showing an example of a relationship between a timing of light emission adjustment and power consumption in the display device 1 according to the present embodiment. In FIG. 5, the horizontal axis represents switching of frames and time, and the vertical axis represents power consumption. The frames are displayed in the order of an $n-2^{th}$ frame, . . . , an $n+2^{th}$ frame.

The $n-2^{th}$ frame and the $n-1^{th}$ frame are dark frames.

FIG. 5 shows the case where the $n+1^{th}$ frame and frames after the $n+1^{th}$ frame are frames having first brightness and the case where they are frames having second brightness. In FIG. 5, the second brightness is greater than the first brightness.

When the $n^{th}$ frame is an image brighter than the $n-1^{th}$ frame, the present power consumption of the $n^{th}$ frame calculated by integrating pixel values of the $n^{th}$ frame increases when the $n^{th}$ frame is displayed. An inclination of this increase in power consumption becomes greater as the $n^{th}$ frame is brighter.

In the present embodiment, a certain threshold value Th1 is set, and light emission is stopped with a timing with which the power consumption of the $n^{th}$ frame exceeds this threshold value Th1. When the $n^{th}$ frame has the first brightness, a timing with which the power consumption of the $n^{th}$ frame exceeds the threshold value Th1 is later than in the case where it has the second brightness, the amount of black insertion is smaller than in the case of the second brightness. When the $n^{th}$ frame has the second brightness greater than the first brightness, a timing with which the power consumption of the $n^{th}$ frame exceeds the threshold value Th1 is earlier than in the case where it has the first brightness, and the amount of black insertion is greater than in the case of the first brightness. Therefore, the amount of black insertion according to brightness can be automatically determined by stopping light emission with a timing with which the power consumption of the $n^{th}$ frame exceeds the threshold value Th1.

In the present embodiment, the amount of black insertion may be increased or decreased in accordance with a difference in power consumption or a difference in brightness between the $n-1^{th}$ frame and the $n^{th}$ frame.

In the display device 1 according to the above-described present embodiment, power consumption can be reduced, a flash phenomenon can be restrained, the amount of black insertion can be adjusted in accordance with the brightness of a frame, and the deterioration of display quality can be prevented.

Second Embodiment

In the present embodiment, a modification of the above-described first embodiment will be described.

In the above-described first embodiment, when a difference in power consumption or a difference in brightness between the $n-1^{th}$ frame and the $n^{th}$ frame is small, the amount of black insertion into the $n^{th}$ frame is also adjusted to be small.

However, if a black insertion is made in display even in a slight amount of black insertion, this black insertion may be visibly recognized by a user, and for example, a flicker may occur to cause the deterioration of display quality.

Thus, in the present embodiment, the display device 1 in which a black insertion is not made if a difference in power consumption or a difference in brightness between adjacent frames is so small that a flash phenomenon does not occur will be described.

While the $n^{th}$ frame to be displayed is being displayed, it can be estimated how much the $n^{th}$ frame and the $n+1^{th}$ frame are different in power consumption or brightness.

For example, in the present embodiment, the brightness adjuster 11 estimates the brightness of the $n^{th}$ frame and the brightness of the $n+1^{th}$ frame based on the brightness of the $n-1^{th}$ frame and a change in the power consumption of the $n^{th}$ frame.

Then, the brightness adjuster 11 performs control not to make a stop of light emission (black insertion) to the $n^{th}$ frame, when a difference in brightness obtained by subtracting the estimated brightness of the $n+1^{th}$ frame from the estimated brightness of the $n^{th}$ frame is such that the user does not visibly recognize it as a flash phenomenon.

Figure 6:
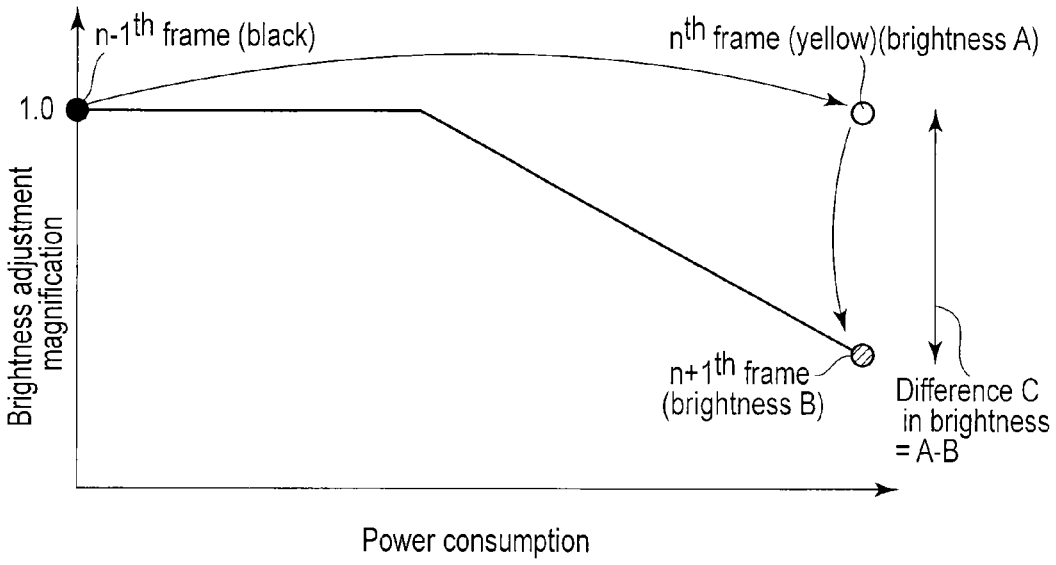
FIG. 6 is a graph showing an example of a relationship between power consumption and a brightness adjustment magnification in the case where a switch is made from an $n-1^{th}$ black frame to an $n^{th}$ yellow frame.

FIG. 6 is a graph showing an example of a relationship between power consumption and a brightness adjustment magnification in the case where a switch is made from an $n-1^{th}$ black frame to an $n^{th}$ yellow frame.

For example, the brightness adjuster 11 estimates brightness A of the $n^{th}$ frame and brightness B of the $n+1^{th}$ frame from the brightness of the $n-1^{th}$ black frame and the above-described inclination of a change in power consumption of FIG. 5. Here, for example, the brightness B of the $n+1^{th}$ frame may be a value obtained by multiplying the estimated brightness A of the $n^{th}$ frame by a brightness adjustment magnification calculated based on the estimated brightness of the $n^{th}$ frame.

The brightness adjuster 11 calculates a difference C in brightness based on a value obtained by subtracting the estimated brightness B of the $n+1^{th}$ frame from the estimated brightness A of the $n^{th}$ frame.

The brightness adjuster 11 performs control not to transmit the black insertion signal 18 to the timing controller 14, when the difference C in brightness is smaller than a threshold value Th3.

Figure 7:
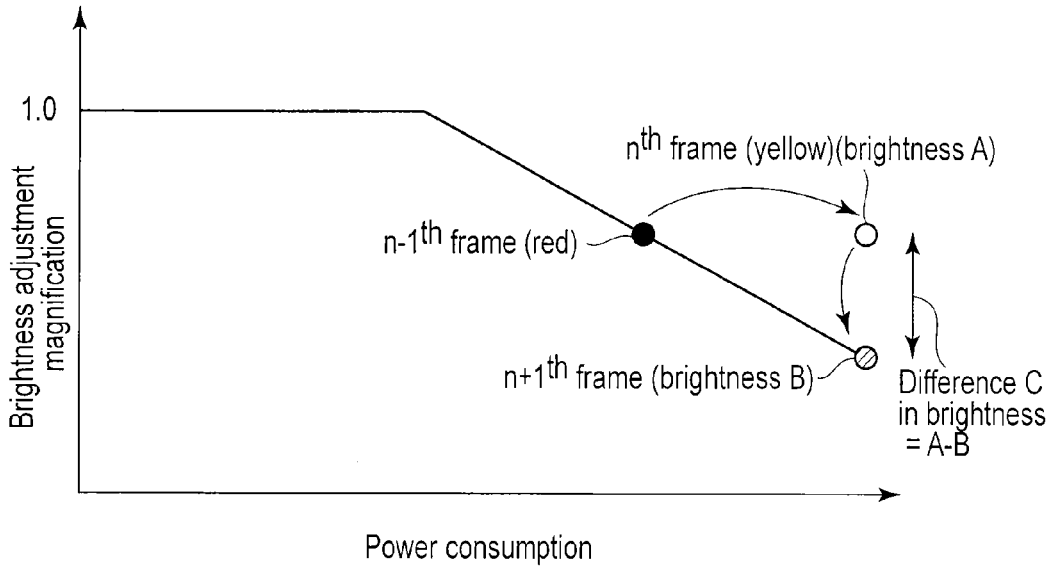
FIG. 7 is a graph showing an example of a relationship between power consumption and a brightness adjustment magnification in the case where a switch is made from an $n-1^{th}$ red frame to the $n^{th}$ yellow frame.

FIG. 7 is a graph showing an example of a relationship between power consumption and a brightness adjustment magnification in the case where a switch is made from an $n-1^{th}$ red frame to the $n^{th}$ yellow frame.

In FIG. 7, the brightness adjuster 11 estimates the brightness A of the $n^{th}$ frame and the brightness B of the $n+1^{th}$ frame based on the brightness of the $n-1^{th}$ red frame and the inclination of a change in power consumption of the $n^{th}$ frame while the $n^{th}$ yellow frame is displayed, and estimates the difference C in brightness obtained by subtracting the estimated brightness of the $n+1^{th}$ frame from the estimated brightness of the $n^{th}$ frame. The brightness adjuster 11 does not transmit the black insertion signal 18 to the timing controller 14, not allowing a black insertion, because the $n^{th}$ yellow frame to be displayed is brighter than the previous $n-1^{th}$ red frame, but the difference C in brightness is smaller than the threshold value Th3.

Figure 8:
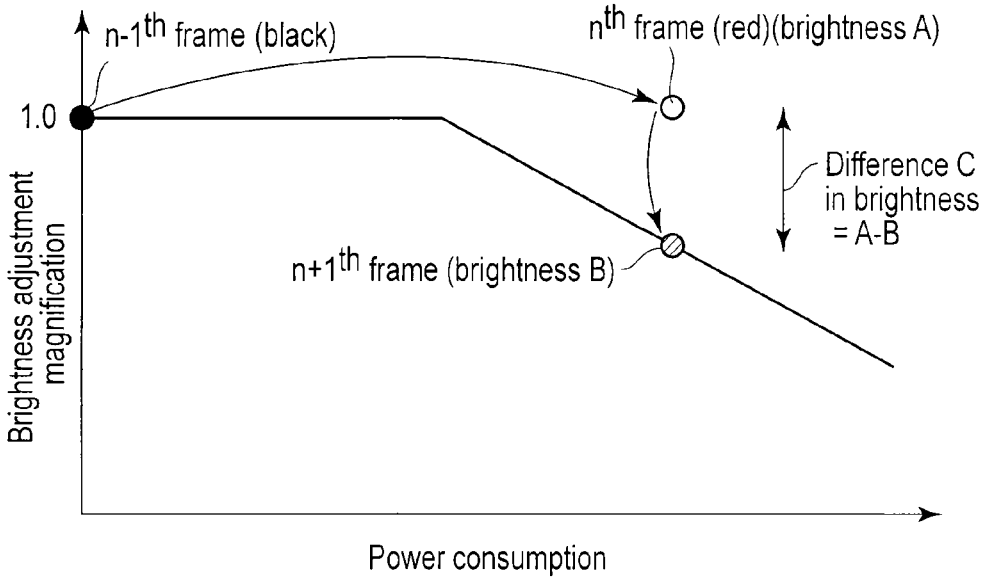
FIG. 8 is a graph showing an example of a relationship between power consumption and a brightness adjustment magnification in the case where a switch is made from the $n-1^{th}$ black frame to an $n^{th}$ red frame.

FIG. 8 is a graph showing an example of a relationship between power consumption and a brightness adjustment magnification in the case where a switch is made from the $n-1^{th}$ black frame to an $n^{th}$ red frame.

In FIG. 8, the brightness adjuster 11 estimates the brightness A of the $n^{th}$ frame and the brightness B of the $n+1^{th}$ frame based on the brightness of the $n-1^{th}$ black frame and the inclination of a change in power consumption of the $n^{th}$ frame while the $n^{th}$ frame is displayed, and estimates the difference C in brightness obtained by subtracting the estimated brightness of the $n+1^{th}$ frame from the estimated brightness of the $n^{th}$ frame. The brightness adjuster 11 does not transmit the black insertion signal 18 to the timing controller 14, not allowing a black insertion, because the $n^{th}$ red frame to be displayed is brighter than the previous $n-1^{th}$ black frame, but the difference C in brightness is smaller than the threshold value Th3.

In the above-described present embodiment, a difference in brightness between the $n^{th}$ frame to be displayed and the $n+1^{th}$ frame after the $n^{th}$ frame is estimated, it is determined whether or not a black insertion is made and the amount of black insertion is determined, and if the difference C in brightness is such that a flash phenomenon is not visibly recognized, a black insertion is not made, and the amount of back insertion is minimized.

Therefore, in the present embodiment, without providing a frame memory, power consumption can be restrained, a flash phenomenon can be prevented, and the deterioration of image quality can be prevented.

Third Embodiment

In the above-described first and second embodiments, examples in the case where frames include a red pixel, a green pixel and a blue pixel have been described.

However, the frames may include other color pixels.

More specifically, for example, the frames may include a red pixel, a green pixel, a blue pixel and a white pixel.

In this case, the above-described power consumption $Power_n$ of the $n^{th}$ frame is calculated on the basis of Equation (6).

$$Power_n=\{\Sigma R_{IN(n)}\}\times a_R+\{\Sigma G_{IN(n)}\}\times a_G+\{\Sigma B_{IN(n)}\}\times a_B+\{\Sigma W_{IN(n)}\}\times a_W \quad (6)$$

Here, the brightness of a white pixel included in the $n^{th}$ frame is $W_{IN(n)}$. $a_W$ is a coefficient by which the brightness of a white pixel is converted into power consumption.

A brightness $W_{OUT(n+1)}$ of a white pixel included in the $n+1^{th}$ frame of the output data 17 is calculated based on Equation (7).

$$W_{OUT(n+1)}=K_{n+1}\times W_{IN(n+1)} \quad (7)$$

The brightness adjuster 11 carries out such a calculation. The same advantage as those of the above-described first and second embodiments can be thereby obtained also for a frame including a white pixel.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device displaying an $n-1^{th}$ frame (n is an integer which is greater than or equal to 2) and an $n^{th}$ frame included in display data in this order, comprising:

a display panel which displays an image based on the display data;

a power consumption calculator which calculates power consumption of the $n-1^{th}$ frame;

a brightness adjuster which determines whether or not the $n^{th}$ frame is brighter than the $n-1^{th}$ frame, and adjusts brightness of the $n^{th}$ frame based on a brightness adjustment magnification of the $n^{th}$ frame calculated based on the power consumption of the $n-1^{th}$ frame and a decreasing function which represents a relationship in which the brightness adjustment magnification decreases as the power consumption increases, when the $n^{th}$ frame is not brighter than the $n-1^{th}$ frame; and a timing controller which stops light emission with an arbitrary timing when the $n^{th}$ frame is displayed, when the $n^{th}$ frame is brighter than the $n-1^{th}$ frame, wherein the brightness adjuster determines whether or not a difference between the brightness of the $n^{th}$ frame and brightness of the $n-1^{th}$ frame exceeds a threshold value, when the $n^{th}$ frame is brighter than the $n-1^{th}$ frame, and the timing controller stops light emission of the $n^{th}$ frame based on a timing determined based on the difference, when the difference exceeds the threshold value.

2. The display device of claim 1, wherein the brightness adjuster determines whether or not the $n^{th}$ frame is brighter than the $n-1^{th}$ frame, based on brightness of the $n-1^{th}$ frame and the brightness of the $n^{th}$ frame.

3. The display device of claim 1, wherein the display panel displays the $n^{th}$ frame adjusted by the brightness adjuster, when the difference does not exceed the threshold value.

4. The display device of claim 1, wherein the power consumption calculator calculates the power consumption of the $n-1^{th}$ frame and power consumption of the $n^{th}$ frame, and the brightness adjuster determines whether or not the $n^{th}$ frame is brighter than the $n-1^{th}$ frame, based on the power consumption of the $n-1^{th}$ frame and the power consumption of the $n^{th}$ frame.

5. The display device of claim 1, wherein the power consumption calculator calculates the power consumption of the $n-1^{th}$ frame and power consumption of the $n^{th}$ frame, the brightness adjuster determines whether or not the power consumption of the $n^{th}$ frame exceeds a threshold value, when the $n^{th}$ frame is brighter than the $n-1^{th}$ frame, and the timing controller stops light emission of the $n^{th}$ frame, when the power consumption of the $n^{th}$ frame exceeds the threshold value.

6. The display device of claim 1, wherein the power consumption calculator calculates the power consumption of the $n-1^{th}$ frame and power consumption of the $n^{th}$ frame, and the brightness adjuster determines whether or not a difference between the power consumption of the $n^{th}$ frame and the power consumption of the $n-1^{th}$ frame exceeds a threshold value, when the $n^{th}$ frame is brighter than the $n-1^{th}$ frame.

7. The display device of claim 1, wherein the power consumption calculator calculates the power consumption of the $n-1^{th}$ frame and power consumption of the $n^{th}$ frame, the brightness adjuster determines whether or not a difference between the power consumption of the $n^{th}$ frame and the power consumption of the $n-1^{th}$ frame exceeds a threshold value, when the $n^{th}$ frame is brighter than the $n-1^{th}$ frame, and the display panel displays the $n^{th}$ frame adjusted by the brightness adjuster, when the difference does not exceed the threshold value.

8. The display device of claim 1, wherein the display data includes the $n-1^{th}$ frame, the $n^{th}$ frame, and an $n+1^{th}$ frame, the power consumption calculator calculates the power consumption of the $n-1^{th}$ frame and power consumption of the $n^{th}$ frame, the brightness adjuster estimates the brightness of the $n^{th}$ frame and brightness of the $n+1^{th}$ frame based on brightness of the $n-1^{th}$ frame and an inclination at which the power consumption of the $n^{th}$ frame increases, when the $n^{th}$ frame is brighter than the $n-1^{th}$ frame, and determines whether or not a difference in brightness obtained by subtracting the estimated brightness of the $n+1^{th}$ frame from the estimated brightness of the $n^{th}$ frame is smaller than a threshold value for the difference in brightness, and the timing controller does not stop light emission when the $n^{th}$ frame is displayed, when the difference in brightness is smaller than the threshold value for the difference in brightness.

9. A method for controlling a display device displaying an $n-1^{th}$ frame (n is an integer which is greater than or equal to 2) and an $n^{th}$ frame included in display data on a display panel in this order, comprising:

calculating power consumption of the $n-1^{th}$ frame;

determining whether or not the $n^{th}$ frame is brighter than the $n-1^{th}$ frame, and adjusting brightness of the $n^{th}$ frame based on a brightness adjustment magnification of the $n^{th}$ frame calculated based on the power consumption of the $n-1^{th}$ frame and a decreasing function which represents a relationship in which the brightness adjustment magnification decreases as the power consumption increases, when the $n^{th}$ frame is not brighter than the $n-1^{th}$ frame; and stopping light emission with an arbitrary timing when the $n^{th}$ frame is displayed, when the $n^{th}$ frame is brighter than the $n-1^{th}$ frame, wherein the determining comprises determining whether or not a difference between the brightness of the $n^{th}$ frame and brightness of the $n-1^{th}$ frame exceeds a threshold value, when the $n^{th}$ frame is brighter than the $n-1^{th}$ frame, and the stopping comprises stopping light emission of the $n^{th}$ frame based on a timing determined based on the difference, when the difference exceeds the threshold value.

10. The method of claim 9, wherein the determining comprises determining whether or not the $n^{th}$ frame is brighter than the $n-1^{th}$ frame, based on brightness of the $n-1^{th}$ frame and the brightness of the $n^{th}$ frame.

11. The method of claim 9, wherein the method further comprises displaying the adjusted $n^{th}$ frame on the display panel, when the difference does not exceed the threshold value.

12. The method of claim 9, wherein the calculating comprises calculating the power consumption of the $n-1^{th}$ frame and power consumption of the $n^{th}$ frame, and the determining comprises determining whether or not the $n^{th}$ frame is brighter than the $n-1^{th}$ frame, based on the power consumption of the $n-1^{th}$ frame and the power consumption of the $n^{th}$ frame.

13. The method of claim 9, wherein the calculating comprises calculating the power consumption of the $n-1^{th}$ frame and power consumption of the $n^{th}$ frame, the determining comprises determining whether or not the power consumption of the $n^{th}$ frame exceeds a threshold value, when the $n^{th}$ frame is brighter than the $n-1^{th}$ frame, and the stopping comprises stopping light emission of the $n^{th}$ frame, when the power consumption of the $n^{th}$ frame exceeds the threshold value.

14. The method of claim 9, wherein the calculating comprises calculating the power consumption of the $n-1^{th}$ frame and power consumption of the $n^{th}$ frame, and the determining comprises determining whether or not a difference between the power consumption of the $n^{th}$ frame and the power consumption of the $n-1^{th}$ frame exceeds a threshold value, when the $n^{th}$ frame is brighter than the $n-1^{th}$ frame.

15. The method of claim 9, wherein the calculating comprises calculating the power consumption of the $n-1^{th}$ frame and power consumption of the $n^{th}$ frame, the determining comprises determining whether or not a difference between the power consumption of the $n^{th}$ frame and the power consumption of the $n-1^{th}$ frame exceeds a threshold value, when the $n^{th}$ frame is brighter than the $n-1^{th}$ frame, and the method further comprises displaying the adjusted $n^{th}$ frame on the display panel, when the difference does not exceed the threshold value.

16. The method of claim 9, wherein the display data includes the $n-1^{th}$ frame, the $n^{th}$ frame, and an $n+1^{th}$ frame, the calculating comprises calculating the power consumption of the $n-1^{th}$ frame and power consumption of the $n^{th}$ frame, the determining comprises estimating the brightness of the $n^{th}$ frame and brightness of the $n+1^{th}$ frame based on brightness of the $n-1^{th}$ frame and an inclination at which the power consumption of the $n^{th}$ frame increases, when the $n^{th}$ frame is brighter than the $n-1^{th}$ frame, and determining whether or not a difference in brightness obtained by subtracting the estimated brightness of the $n+1^{th}$ frame from the estimated brightness of the $n^{th}$ frame is smaller than a threshold value for the difference in brightness, and the stopping does not stop light emission when the $n^{th}$ frame is displayed, when the difference in brightness is smaller than the threshold value for the difference in brightness.

* * * * *